US008016691B2

(12) United States Patent
Stites

(10) Patent No.: US 8,016,691 B2
(45) Date of Patent: Sep. 13, 2011

(54) GOLF CLUB HEAD OR OTHER BALL STRIKING DEVICE HAVING STIFFENED FACE PORTION

(75) Inventor: John Thomas Stites, Weatherford, TX (US)

(73) Assignee: Nike, Inc., Beaverton, OR (US)

( * ) Notice: Subject to any disclaimer, the term of this patent is extended or adjusted under 35 U.S.C. 154(b) by 211 days.

(21) Appl. No.: 12/421,366

(22) Filed: Apr. 9, 2009

(65) Prior Publication Data

US 2010/0261539 A1 Oct. 14, 2010

(51) Int. Cl.
*A63B 53/06* (2006.01)
*A63B 53/00* (2006.01)

(52) U.S. Cl. ..... 473/290; 473/346; 473/342; 473/345

(58) Field of Classification Search ..... 473/290, 473/346, 345, 342
See application file for complete search history.

(56) References Cited

U.S. PATENT DOCUMENTS 4,145,052 A * 3/1979 Janssen et al. ..... 473/338
5,013,041 A * 5/1991 Sun et al. ..... 473/252
5,489,097 A * 2/1996 Simmons ..... 473/326
5,863,261 A * 1/1999 Eggiman ..... 473/329
5,890,973 A 4/1999 Gamble
6,558,271 B1 5/2003 Beach et al.
6,923,734 B2 * 8/2005 Meyer ..... 473/336
7,819,757 B2 * 10/2010 Soracco et al. ..... 473/332
2004/0166959 A1 8/2004 Chen
2004/0214658 A1 10/2004 Meyer

OTHER PUBLICATIONS

International Search Report for PCT Application No. PCT/US2010/030154, mailed Jul. 6, 2010.

* cited by examiner

*Primary Examiner* — Gene Kim
*Assistant Examiner* — Michael D Dennis
(74) *Attorney, Agent, or Firm* — Banner & Witcoff, Ltd.

(57) ABSTRACT

A ball striking device, such as a golf club head, has a head that includes a face configured for striking a ball and a body connected to the face, the body being adapted for connection of a shaft thereto. The head may include one or more stiffening elements or other structures contacting an inner surface of the face, to provide locally increased stiffness to particular areas of the face. The stiffening element includes a chamber adapted to contain a viscous substance. The viscous substance can be selected and inserted into the chamber to create regions of increased stiffness in desired locations, leaving other regions of the face to have increased flexibility as compared to the stiffened regions.

16 Claims, 14 Drawing Sheets

GOLF CLUB HEAD OR OTHER BALL STRIKING DEVICE HAVING STIFFENED FACE PORTION

TECHNICAL FIELD

The invention relates generally to ball striking devices, such as golf club heads, having a stiffened portion on the ball striking face thereof. Certain aspects of this invention relate to golf club heads having a stiffening element that includes a chamber adapted to contain a viscous substance therein.

BACKGROUND

Golf is enjoyed by a wide variety of players—players of different genders, and players of dramatically different ages and skill levels. Golf is somewhat unique in the sporting world in that such diverse collections of players can play together in golf outings or events, even in direct competition with one another (e.g., using handicapped scoring, different tee boxes, etc.), and still enjoy the golf outing or competition. These factors, together with increased golf programming on television (e.g., golf tournaments, golf news, golf history, and/or other golf programming) and the rise of well known golf superstars, at least in part, have increased golfs popularity in recent years, both in the United States and across the world.

Golfers at all skill levels seek to improve their performance, lower their golf scores, and reach that next performance "level." Manufacturers of all types of golf equipment have responded to these demands, and recent years have seen dramatic changes and improvements in golf equipment. For example, a wide range of different golf ball models now are available, with some balls designed to fly farther and straighter, provide higher or flatter trajectory, provide more spin, control, and feel (particularly around the greens), etc.

Being the sole instrument that sets a golf ball in motion during play, the golf club also has been the subject of much technological research and advancement in recent years. For example, the market has seen improvements in golf club heads, shafts, and grips in recent years. Additionally, other technological advancements have been made in an effort to better match the various elements of the golf club and characteristics of a golf ball to a particular user's swing features or characteristics (e.g., club fitting technology, ball launch angle measurement technology, etc.).

Despite the various technological improvements, golf remains a difficult game to play at a high level. For a golf ball to reliably fly straight and in the desired direction, a golf club must meet the golf ball square (or substantially square) to the desired target path. Moreover, the golf club must meet the golf ball at or close to a desired location on the club head face (i.e., on or near a "desired" or "optimal" ball contact location) to reliably fly straight, in the desired direction, and for a desired distance. Off-center hits may tend to "twist" the club face when it contacts the ball, thereby sending the ball in the wrong direction, imparting undesired hook or slice spin, and/or robbing the shot of distance. Club face/ball contact that deviates from squared contact and/or is located away from the club's desired ball contact location, even by a relatively minor amount, also can launch the golf ball in the wrong direction, often with undesired hook or slice spin, and/or can rob the shot of distance. Accordingly, club head features that can help a user keep the club face square with the ball would tend to help the ball fly straighter and truer, in the desired direction, and often with improved and/or reliable distance.

Like other golf clubs, drivers and other "woods" also must make square contact with the golf ball, in the desired direction or path, in order to produce straight and true shots in the desired direction. Even small deviations from squareness between the club head and the golf ball at the point of contact can cause inaccuracy. Because drivers and other wood-type golf clubs typically launch the ball over greater distances than other clubs, these inaccuracies can be exaggerated.

Many off-center golf hits are caused by common errors in swinging the golf club that are committed repeatedly by the golfer, and which may be similarly committed by many other golfers. As a result, patterns can often be detected, where a large percentage of off-center hits occur in certain areas of the club face. For example, one such pattern that has been detected is that many high handicap golfers tend to hit the ball on the low-heel area of the club face and/or on the high-toe area of the club face. Other golfers may tend to miss in other areas of the club face. Because golf clubs are typically designed to contact the ball at or around the center of the face, such off-center hits may result in less energy being transferred to the ball, decreasing the distance of the shot. The energy or velocity transferred to the ball by a golf club also may be related, at least in part, to the flexibility of the club face at the point of contact, and can be expressed using a measurement called "coefficient of restitution" (or "COR"). The maximum COR for golf club heads is currently limited by the USGA at 0.83. Accordingly, a need exists to customize or adjust the local flexibility of a golf club face to provide maximized COR in the areas of the face where off-center hits tend to occur most, without exceeding current COR limitations.

The present device and method are provided to address the problems discussed above and other problems, and to provide advantages and aspects not provided by prior ball striking devices of this type. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the invention relate to ball striking devices, such as golf clubs, with a head that includes a face configured for striking a ball and a body connected to the face, the body being adapted for connection of a shaft thereto. Various example structures of heads described herein include one or more stiffening elements or other structures that can contact the face to provide locally increased stiffness to particular areas of the face. The stiffening element can be adapted to contain a viscous substance to influence the stiffening effect of the stiffening element on the face and create targeted regions of increased stiffness (e.g., in the upper heel and/or lower toe quadrants) in desired locations, which leaves other, targeted regions of the face to have increased flexibility as compared to the stiffened regions. By locating the targeted regions of increased face flexibility at locations on a face where a golfer tends to hit the ball, the golf shot may experience increased "kick" off the face on off-center hits (provided the off-center hits impact the face at the locations of increased flexibility and at a sufficient velocity), e.g., due to the increased COR response and a trampoline-like effect at these off-center locations. While increasing the COR response at some targeted off-center locations, the regions of increased stiffness may be used to control the overall club head's COR response and to assure that the COR of the club head remains within the constraints of the Rules of Golf.

According to one aspect, the head includes a retainer for holding the stiffening element, such that the stiffening element is removable from the retainer. In this configuration, the stiffening element may be interchangeable with a second stiffening element including a chamber containing a second viscous substance. The second viscous substance may have a property that is different from the original viscous substance, which changes the stiffening effect on the face.

According to another aspect of the invention, the stiffening element may further include a port in communication with the chamber, where the port is configured for filling, emptying, and/or refilling the viscous substance. In this configuration, the viscous substance contained in the stiffening element can be emptied and the chamber can be refilled with a second viscous substance. The second viscous substance may have a property that is different from the original viscous substance, which changes the stiffening effect on the face.

According to another aspect of the invention, the head may include a plurality of stiffening elements contacting the inner surface of the face, each of which may contain different viscous substances. Similarly, a stiffening element may contain more than one chamber, each of which may contain different viscous substances. A stiffening element containing multiple chambers may be provided as a cartridge that is configured to be removably and interchangeably connected to the inner surface of the face.

According to still another aspect of the invention, at least a portion of the body is removable to provide access to the stiffening element for filling, emptying, and/or refilling the chamber. In one example, the head is formed of a face member having a cup face structure, including the face and a wall extending rearward from the face, and a backbody member connected to the wall of the face member. The backbody member and at least a portion of the wall of the face member define the body. The backbody member may be removable to provide access to the stiffening element and/or a port in communication with the chamber of the stiffening element.

Other aspects of this invention relate to face members for use in a ball striking device, including a face, a wall extending rearward from an outer periphery of the face, and a stiffening element as described above. The face has an outer surface configured for striking a ball and an inner surface located rearward and opposite of the outer surface.

Further aspects of the invention relate to methods that can be used for manufacturing or customizing a golf club head, which is provided with a face configured for striking a ball with an outer surface thereof and a body connected to the face. The method includes connecting a stiffening element to the inner surface of the face, such as a stiffening element as described above. The stiffening element includes a chamber adapted to contain a viscous substance.

Additional aspects of the invention relate to methods that can be used for customizing or adjusting a golf club head, which is provided with a face configured for striking a ball with an outer surface thereof, a body connected to the face, and a stiffening element contacting the inner surface of the face. The stiffening element includes a chamber adapted to contain a viscous substance. The method includes filling the chamber with a first viscous substance, where the stiffening element has a stiffening effect on an area of the face contacted by the stiffening element, and the first viscous substance has a property that influences the stiffening effect.

According to one aspect, the method further includes emptying the first viscous substance from the chamber and filling the chamber with a second viscous substance. The second viscous substance has a property that is different from the property of the first viscous substance, such that the stiffening effect of the stiffening element changes due to the difference in the properties between the first viscous substance and the second viscous substance.

According to another aspect, the method further includes selecting the first viscous substance from a plurality of viscous substances for filling the chamber, based on the property of the viscous substance. The property in question may be the viscosity of the viscous substance, or another property capable of influencing the stiffening effect of the stiffening element.

Still further aspects of the invention relate to golf clubs that include a golf club head as described above and a shaft connected to the head.

Other features and advantages of the invention will be apparent from the following description taken in conjunction with the attached drawings.

BRIEF DESCRIPTION OF THE DRAWINGS

To allow for a more full understanding of the present invention, it will now be described by way of example, with reference to the accompanying drawings in which.

DETAILED DESCRIPTION

Figure 1:
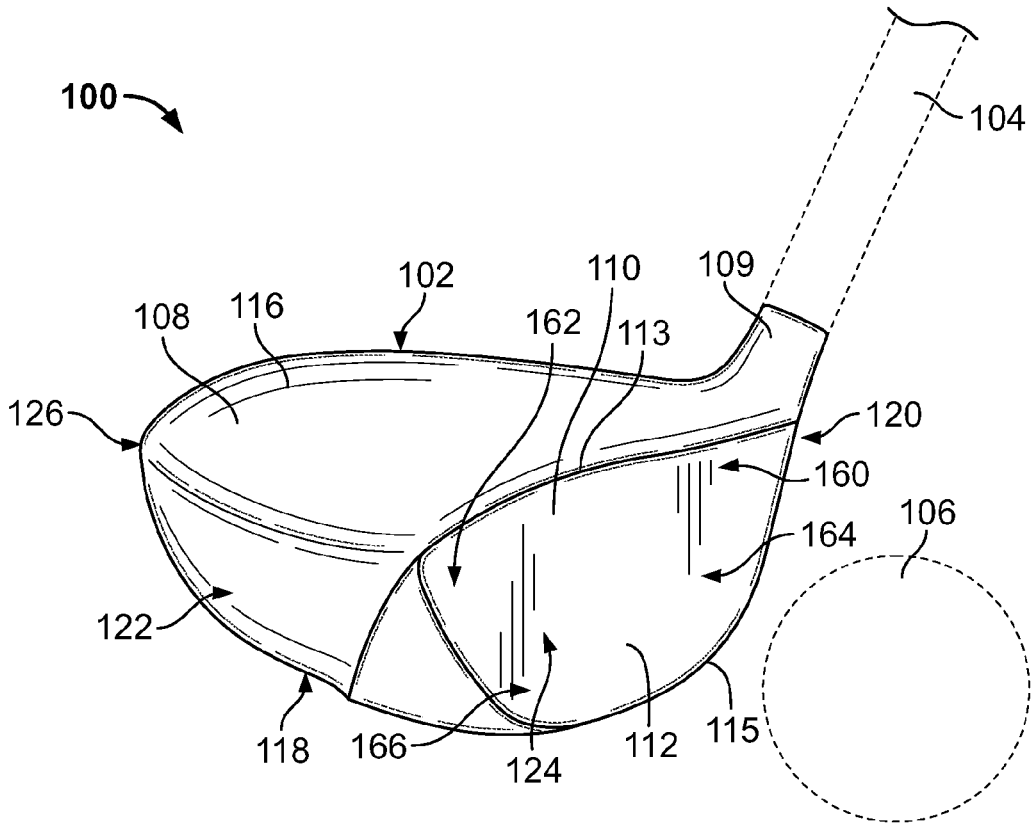
FIG. 1 is a perspective view of an illustrative embodiment of a head of a ball striking device according to the present invention, shown with a ball.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft or handle member, and it may be attached to the shaft or handle in some manner.

The terms "shaft" and "handle" are used synonymously and interchangeably in this specification, and they include the portion of a ball striking device (if any) that the user holds during a swing of a ball striking device.

"Integral joining technique" means a technique for joining two pieces so that the two pieces effectively become a single, integral piece, including, but not limited to, irreversible joining techniques, such as adhesively joining, cementing, welding, brazing, soldering, or the like, where separation of the joined pieces cannot be accomplished without structural damage thereto.

"Viscous substance" means any liquid, semi-solid, or other non-solid and non-gaseous flowable substance having measurable viscosity using any known measurement technique.

In general, aspects of this invention relate to ball striking devices, such as golf club heads, golf clubs, putter heads, putters, and the like. Such ball striking devices, according to at least some examples of the invention, may include a ball striking head and a ball striking surface. In the case of a golf club, the ball striking surface is a substantially flat surface on one face of the ball striking head. Some more specific aspects of this invention relate to wood-type golf clubs and golf club heads, including drivers, fairway woods, wood-type hybrid clubs, and the like, although aspects of this invention also may be practiced on irons, iron-type hybrid clubs, and the like.

According to various aspects of this invention, the ball striking device may be formed of one or more of a variety of materials, such as metals (including metal alloys), ceramics, polymers, composites, fiber-reinforced composites, and wood, and may be formed in one of a variety of configurations, without departing from the scope of the invention. In one illustrative embodiment, some or all components of the head, including the face and at least a portion of the body of the head, are made of metal. It is understood that the head may contain components made of several different materials, including carbon-fiber and other components. Additionally, the components may be formed by various forming methods. For example, metal components (such as titanium, aluminum, titanium alloys, aluminum alloys, steels (including stainless steels), and the like) may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, and/or other known techniques.

The various figures in this application illustrate examples of ball striking devices according to this invention. When the same reference number appears in more than one drawing, that reference number is used consistently in this specification and the drawings refer to the same or similar parts throughout.

At least some examples of ball striking devices according to this invention relate to golf club head structures, including heads for wood-type golf clubs, such as drivers. Such devices may include a one-piece construction or a multiple-piece construction. An example structure of ball striking devices according to this invention will be described in detail below in conjunction with FIG. 1, and will be referred to generally using reference numeral "100."

FIG. 1 illustrates an example of a ball striking device 100 in the form of a golf driver, in accordance with at least some examples of this invention. The ball striking device 100 includes a ball striking head 102 and a shaft 104 connected to the ball striking head 102 and extending therefrom. A ball 106 in use is also schematically shown in FIG. 1, in a position to be struck by the ball striking device 100.

The ball striking head 102 of the ball striking device 100 of FIG. 1 has a face 112 connected to a body 108, with a hosel 109 extending therefrom. Any desired hosel and/or head/shaft interconnection structure may be used without departing from this invention, including conventional hosel and/or head/shaft interconnection structures as are known and used in the art. For reference, the head 102 generally has a top 116, a bottom or sole 118, a heel 120 proximate the hosel 109, a toe 122 distal from the hosel 109, a front 124, and a back or rear 126. The shape and design of the head 102 may be partially dictated by the intended use of the device 100. In the club 100 shown in FIG. 1, the head 102 has a relatively large volume, as the club 100 is designed for use as a driver or wood-type club, intended to hit the ball accurately over long distances. In other applications, such as for a different type of golf club, the head may be designed to have different dimensions and configurations. When configured as a driver, the club head may have a volume of at least 400 cc, and in some structures, at least 450 cc, or even at least 460 cc. Other appropriate sizes for other club heads may be readily determined by those skilled in the art.

Figure 2:
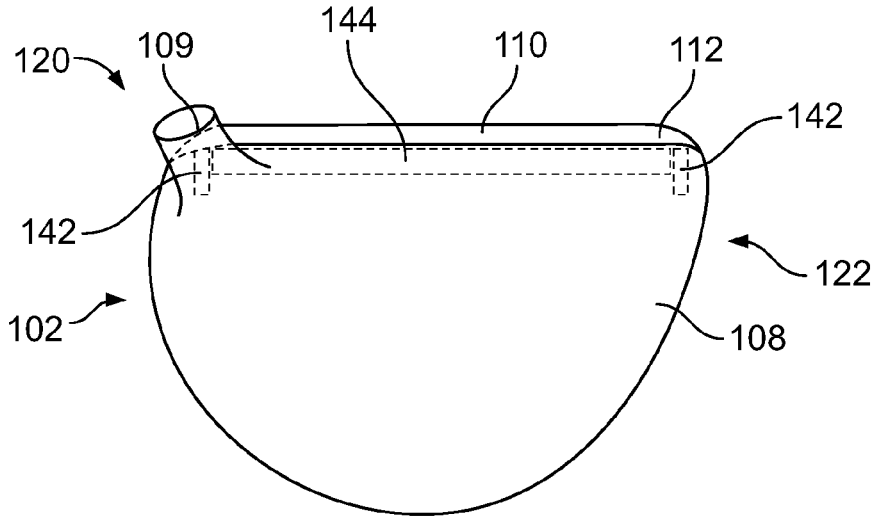
FIG. 2 is a top view of the head of FIG. 1, with a stiffening element and retainers for the stiffening element shown conceptually in broken lines.
Figure 3:
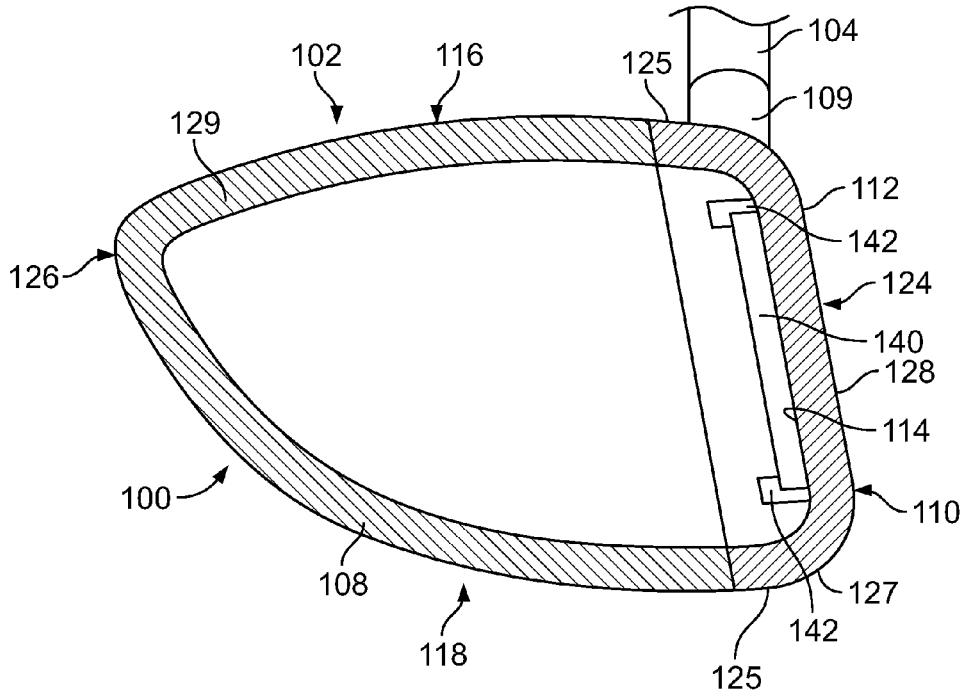
FIG. 3 is a cross-section view of another illustrative embodiment of a head of a ball striking device according to the present invention.

In the illustrative embodiment illustrated in FIGS. 1-3, the head 102 has a hollow structure defining an inner cavity (e.g., defined by the face 112 and the body 108). Thus, the head 102 has a plurality of inner surfaces defined therein. In one embodiment, the hollow center cavity may be filled with air. However, in other embodiments, the head 102 could be filled with another material, such as a foam. In still further embodiments, the solid materials of the head may occupy a greater proportion of the volume, and the head may have a smaller cavity or no inner cavity at all. It is understood that the inner cavity may not be completely enclosed in some embodiments.

The face 112 is located at the front 124 of the head 102, and has a ball striking surface 110 located thereon. The ball striking surface 110 is configured to face a ball 106 in use, and is adapted to strike the ball 106 when the device 100 is set in motion, such as by swinging. As shown, the ball striking surface 110 is relatively flat, occupying most of the face 112. For reference purposes, the portion of the face 112 near the top face edge 113 and the heel 120 of the head 102 is referred to as the "high-heel area" 160; the portion of the face 112 near the top face edge 113 and toe 122 of the head 102 is referred to as the "high-toe area" 162; the portion of the face 112 near the bottom face edge 115 and heel 120 of the head 102 is referred to as the "low-heel area" 164; and the portion of the face 112 near the bottom face edge 115 and toe 122 of the head 102 is referred to as the "low-toe area" 166. Conceptually, these areas 160-166 may be recognized as quadrants of substantially equal size (and/or quadrants extending from a geometrical center of the face 112), though not necessarily with symmetrical dimensions. The face 112 may include some curvature in the top to bottom and/or heel to toe directions (e.g., bulge and roll characteristics), as is known and is conventional in the art. In other embodiments, the surface 110 may occupy a different proportion of the face 112, or the body 108 may have multiple ball striking surfaces 110 thereon. In the illustrative embodiment shown in FIG. 1, the ball striking surface 110 is inclined slightly (i.e., at a loft angle), to give the ball 106 slight lift and spin when struck. In other illustrative embodiments, the ball striking surface 110 may have a different incline or loft angle, to affect the trajectory of the ball 106. Additionally, the face 112 may have a variable thickness and/or may have one or more internal or external inserts in some embodiments.

It is understood that the face 112, the body 108, and/or the hosel 109 can be formed as a single piece or as separate pieces that are joined together. In one illustrative embodiment, the face 112 is formed as part of a face frame member 128, such as shown in FIG. 2, with a wall or walls 125 extending rearward from the edges 127 of the face 112. This configuration is also known as a cup face structure. The body 108 can be formed as a separate piece or pieces joined to the walls 125 of the face frame member 128. In the illustrative embodiment shown in FIG. 2, the body 108 is partially formed by a backbody member 129, which may be a single piece or multiple pieces. The walls 125 of the face frame member 128 combine with the backbody member 129 to form the body 108 of the head 102. These pieces may be connected by an integral joining technique, such as welding, cementing, or adhesively joining. Other known techniques for joining these parts can be used as well, including many mechanical joining techniques, including releasable mechanical engagement techniques. If desired, the hosel 109 may be integrally formed as part of the face frame member 128. Further, a gasket (not shown) may be included between the face frame member 128 and the backbody member 129.

The ball striking device 100 may include a shaft 104 connected to or otherwise engaged with the ball striking head 102, as shown schematically in FIG. 1. The shaft 104 is adapted to be gripped by a user to swing the ball striking device 100 to strike the ball 106. The shaft 104 can be formed as a separate piece connected to the head 102, such as by connecting to the hosel 109, as shown in FIG. 1. In other illustrative embodiments, at least a portion of the shaft 104 may be an integral piece with the head 102, and/or the head 102 may not contain a hosel 109 or may contain an internal hosel structure. Still further embodiments are contemplated without departing from the scope of the invention. The shaft 104 may be constructed from one or more of a variety of materials, including metals, ceramics, polymers, composites, or wood. In some illustrative embodiments, the shaft 104, or at least portions thereof, may be constructed of a metal, such as stainless steel, or a composite, such as a carbon/graphite fiber-polymer composite. However, it is contemplated that the shaft 104 may be constructed of different materials without departing from the scope of the invention, including conventional materials that are known and used in the art.

In general, the head 102 of the ball striking device 100 has one or more stiffening elements contacting the inner surface 114 of the face 112. Each stiffening element provides a stiffening effect on adjacent areas of the face 112, which may include areas of the face 112 contacted by the stiffening element, and can produce one or more areas of increased stiffness on the face 112 as a result. Additionally, each stiffening element has a chamber adapted to contain a viscous substance. The stiffening effect provided by the stiffening element is influenced by the properties of the substance contained therein. By selecting or changing the identity of the substance, the stiffness properties of the head 102 can be adjusted. For example, the overall stiffness of the face 112 can be adjusted, or the local stiffness of desired areas of the face 112 can be adjusted, to control the locations of one or more targeted regions of increased face flexibility, as described above.

One property of the viscous substance that can influence the stiffening effect of the stiffening element is the viscosity of the substance. Substances with higher viscosity have greater resistance to deformation, and thus can provide increased stiffening effect compared to substances having lower viscosity. Another property of the viscous substance that can influence the stiffening effect of the stiffening element is the compressibility of the substance. Many fluids are incompressible or nearly incompressible and may offer greater stiffening effect, while others may have a substantial degree of compressibility. Additionally, the chamber of the stiffening element may contain both viscous and gaseous substances, or a gaseous substance alone. In that configuration, the pressure of the gaseous substance, alone or in combination with the compressibility and/or viscosity of the viscous substance, may influence the stiffening effect. In another embodiment, the viscous substance may solidify after it is inserted into the chamber, such as through a phase change, chemical reaction (including polymerization reactions), etc. For example, the viscous substance may be a thermosetting material or other material that sets as a result of a chemical reaction. As another example, the viscous substance may be a thermoplastic material or other material that may be injected in liquid form and hardens upon cooling. The physical properties of such a solid, such as Young's modulus, ductility, hardness, etc., may also influence the stiffening effect of the stiffening element. It is understood that additional properties of a substance or substances contained in the chamber may influence the stiffening effect.

The head 102 may contain one stiffening element or a plurality of stiffening elements, in a variety of different configurations. Additionally, each stiffening element may contain one chamber or a plurality of chambers. Various embodiments are described below, illustrating different configurations of stiffening elements.

Figure 4:
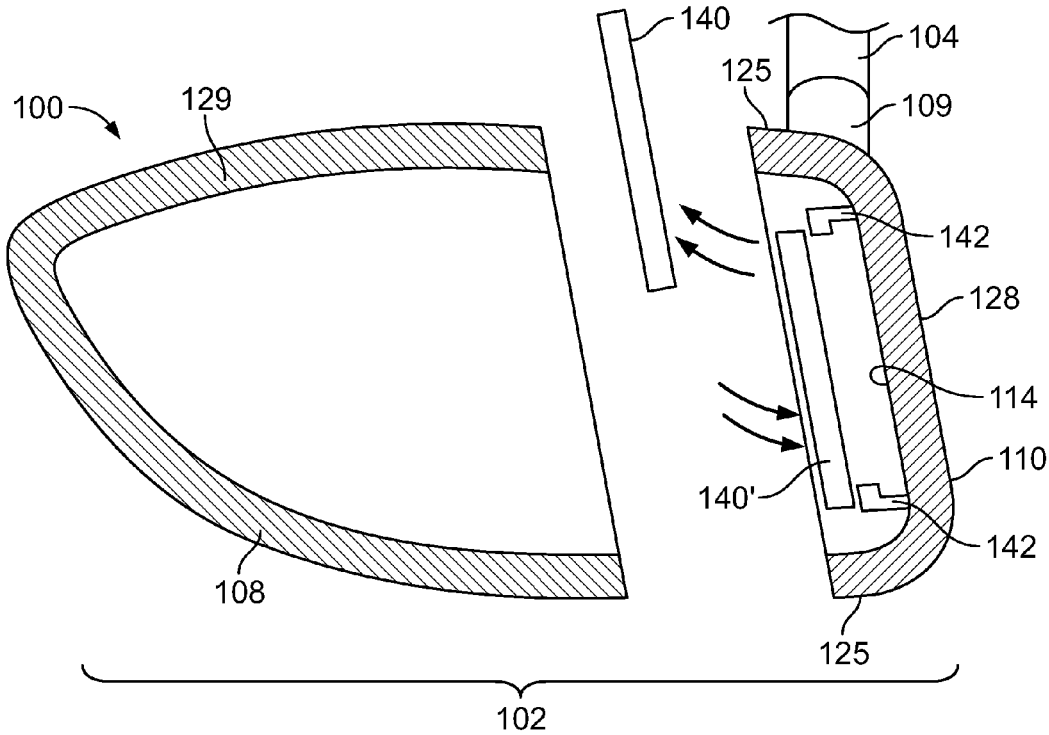
FIG. 4 is an exploded cross-section view of the head of FIG. 3, shown with a first stiffening element being removed from the head and a second stiffening element being inserted into the head.

FIGS. 2-4 depict illustrative embodiments of a golf club head 102 containing a stiffening element 140 in the form of a cartridge that is removably connected to the inner surface 114 of the face 112. As described below, the cartridge 140 contains one or more chambers that can be filled with a viscous substance. The head 102 includes retainers 142 for removably holding the cartridge 140 in contact with the inner surface 114 of the face 112. FIG. 2 illustrates an embodiment that includes retainers 142 that are disposed along the heel and toe sides the face 112, and which engage the vertical sides of the cartridge 140 to hold the cartridge 140 in place. FIGS. 3-4 illustrate an embodiment that includes retainers 142 that are disposed along the top and bottom sides of the face 112, and which engage the horizontal sides of the cartridge 140 to hold the cartridge 140 in place. In one embodiment, at least one of the retainers 142 is flexible and resilient to facilitate insertion and removal of the cartridge 140 from the retainers 142. In another embodiment, the cartridge 140 may contain structure that cooperates with the retainers 142 to hold the cartridge 140 in place. In further embodiments, the cartridge 140 may be inserted into the retainers 142 in another manner, such as by sliding or use of a movable retainer 142. In an alternate embodiment, the cartridge 140 may be configured to be permanently or semi-permanently connected to the inner surface 114 of the face 112, such as by forming integrally with the face or the use of an integral joining technique.

As illustrated in FIG. 4, the cartridge 140 is removable from the retainers 142 once installed, and is also interchangeable with a second cartridge 140' that can be inserted into the retainers 142 in place of the original cartridge 140. The second cartridge 140' may have a different stiffening effect on the face 112, such as by containing a different viscous substance and/or having a different number or configuration of chambers, among other differences. It is understood that a variety of different cartridges can be provided and interchanged as desired to create different stiffening effects and areas of locally increased stiffness on the face.

FIGS. 5-8 illustrate various embodiments of cartridges 140A-D that can be inserted into the retainers 142 of the heads 102 shown in FIGS. 2-4. Each of the cartridges 140A-D illustrated in FIGS. 5-8 contains a plurality of chambers 144A-D located in various locations and configurations, each containing a viscous substance 148. Each of the cartridges 140A-D can provide different stiffening effects when placed in contact with the face 112, and each cartridge 140A-D provides different options for customization due to the different configurations of the chambers 144A-D. As described above, the chambers 144A-D can be emptied and filled with different substances to create different stiffening effects, and each cartridge 140A-D may have individual chambers 144A-D containing different substances, to create areas of relatively greater or lesser stiffness within a particular cartridge 140A-D.

Additionally, each chamber 144A-D includes a port 146 that allows filling and/or emptying the viscous substance 148 into and out of the chamber 144A-D. Accordingly, in one embodiment, the viscous substance 148 in each chamber 144A-D can be changed. It is understood that the port 146 may be accessible using a specialized tool, and may contain a valve or other such structure to prevent leaking of the viscous substance 148. For example, in one embodiment, each port is configured for filling and emptying using a hypodermic needle, and may contain a rubber stopper or other such structure for this purpose. In other embodiments, other configurations may be used, and in one embodiment, the chambers 144A-D are permanently sealed once filled, and the substance inside each chamber 144A-D cannot be changed after sealing.

Figure 5:
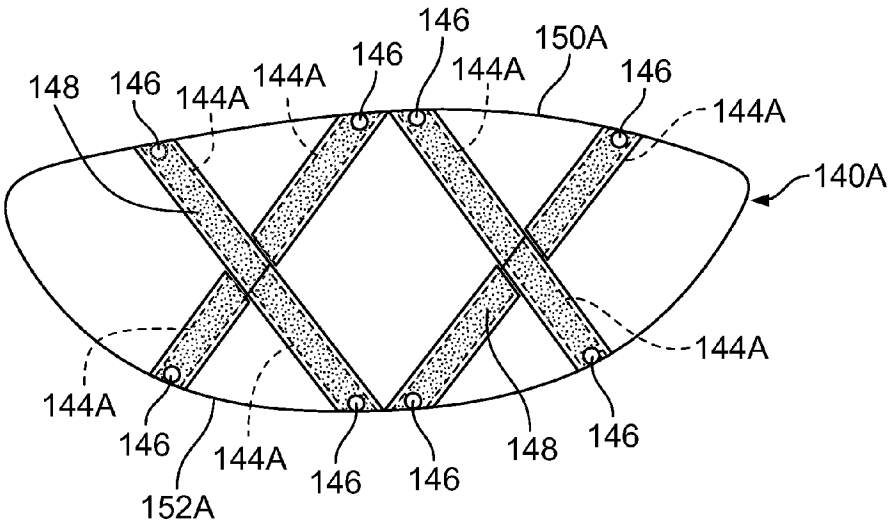
FIG. 5 is a plan view of a first illustrative embodiment of a stiffening element according to the present invention, in the form of a cartridge including multiple chambers, each containing a viscous substance.

FIG. 5 illustrates a stiffening element 140A in the form of a cartridge having eight chambers 144A arranged in two X-shaped formations. Each of the chambers 144A has a port 146 providing access to fill, empty, and refill the chambers 144A with a viscous substance 148. The ports 146 are accessible through the top and bottom edges 150A, 152A of the cartridge 140A.

Figure 6:
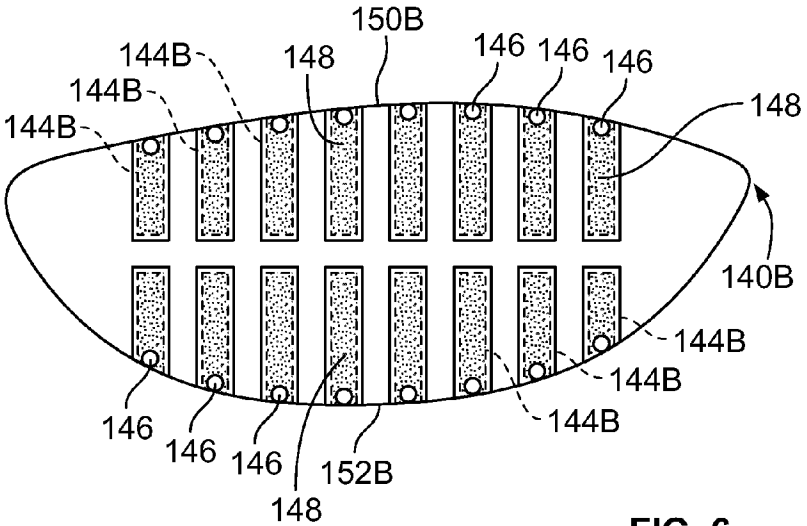
FIG. 6 is a plan view of a second illustrative embodiment of a stiffening element according to the present invention, in the form of a cartridge including multiple chambers, each containing a viscous substance.

FIG. 6 illustrates a stiffening element 140B in the form of a cartridge having sixteen chambers 144B in the form of columns vertically extending from the top and bottom edges 150B, 152B of the cartridge 140B. Each of the chambers 144B has a port 146 providing access to fill, empty, and refill the chambers 144B with a viscous substance 148. The ports 146 are accessible through the top and bottom edges 150B, 152B of the cartridge 140B.

Figure 7:
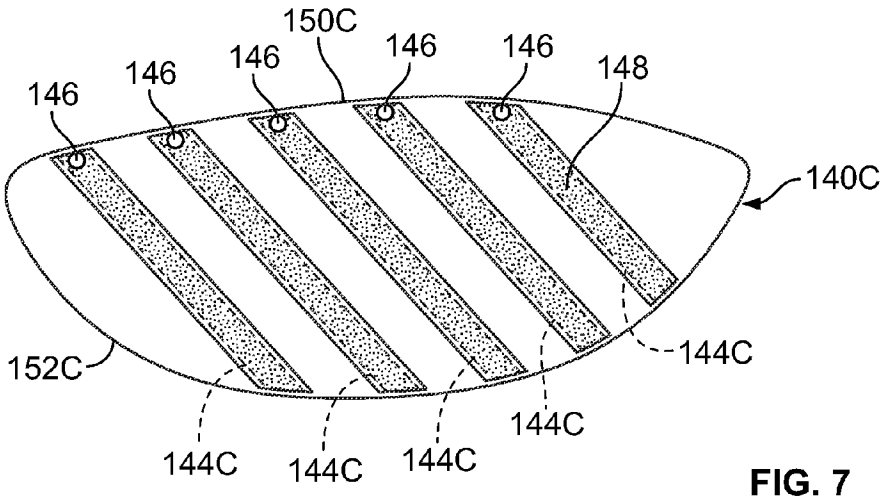
FIG. 7 is a plan view of a third illustrative embodiment of a stiffening element according to the present invention, in the form of a cartridge including multiple chambers, each containing a viscous substance.

FIG. 7 illustrates a stiffening element 140C in the form of a cartridge having five chambers 144C in the form of columns extending diagonally across the cartridge 140C. Each of the chambers 144C has a port 146 providing access to fill, empty, and refill the chambers 144C with a viscous substance 148. The ports 146 are accessible through the top and bottom edges 150C, 152C of the cartridge 140C.

Figure 8:
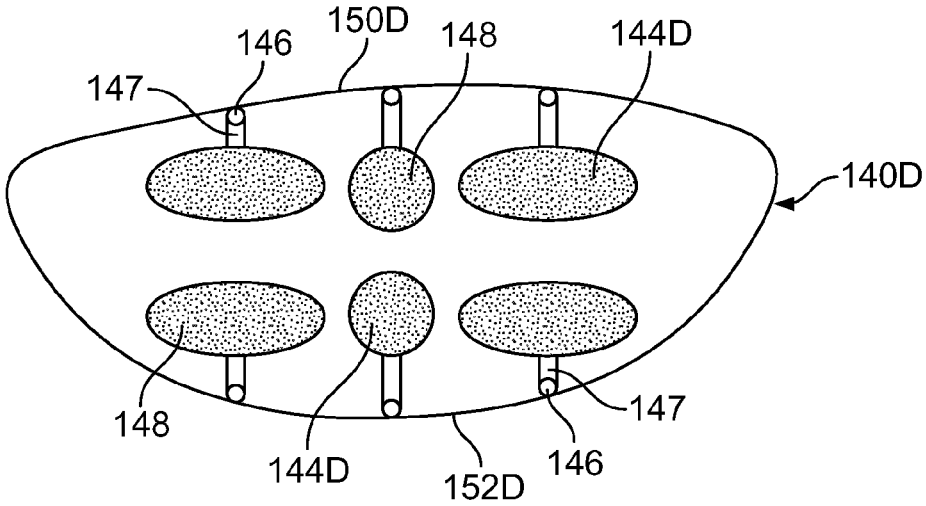
FIG. 8 is a plan view of a fourth illustrative embodiment of a stiffening element according to the present invention, in the form of a cartridge including multiple chambers, each containing a viscous substance.

FIG. 8 illustrates a stiffening element 140D in the form of a cartridge having six chambers 144D in the form of oval cavities distributed across the cartridge 140D. The chambers 144D are positioned at the high-heel, high-center, high-toe, low-heel, low-center, and low-toe areas of the cartridge 140D. Each of the chambers 144D has a port 146 providing access to fill, empty, and refill the chambers 144D with a viscous substance 148. The ports 146 are accessible through the top and bottom edges 150D, 152D of the cartridge 140D, and the ports 146 are provided with passages 147 extending from the edges 150D, 152D of the cartridge 140D to the respective chambers 144D.

It is understood that cartridge-type stiffening elements according to other embodiments may be provided in any number of other configurations. Each different configuration may provide different options for customization of the stiffness of the face 112 of a ball striking head 102 into which the cartridge is inserted. Additionally, in another embodiment, each chamber of the stiffening element may not be provided with an individual port 146, but instead provided with a common port. For example, passages through the cartridge may connect several chambers together, such that multiple chambers can be filled through a single port 146. Further, while the chambers 144A-D of the stiffening elements 140A-D of FIGS. 5-8 are configured for filling and refilling with viscous substances, it is understood that the ports 146 may be permanently closed after filling, as described above.

Figure 9:
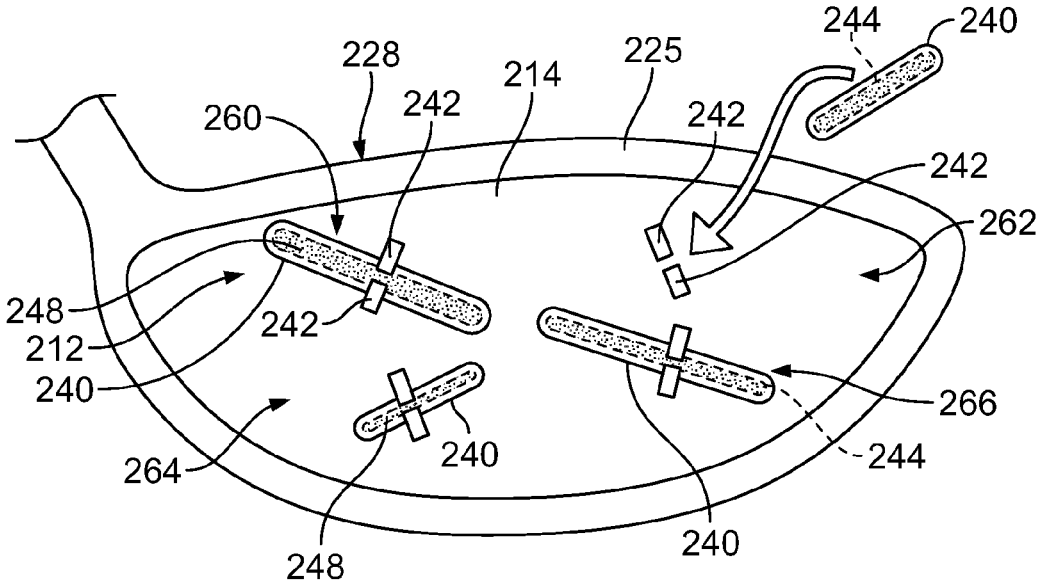
FIG. 9 is a plan view of one illustrative embodiment of a face frame member for a head of a ball striking device according to the present invention, showing three stiffening elements connected to the face frame member and a fourth stiffening element being connected to the face frame member.
Figure 10:
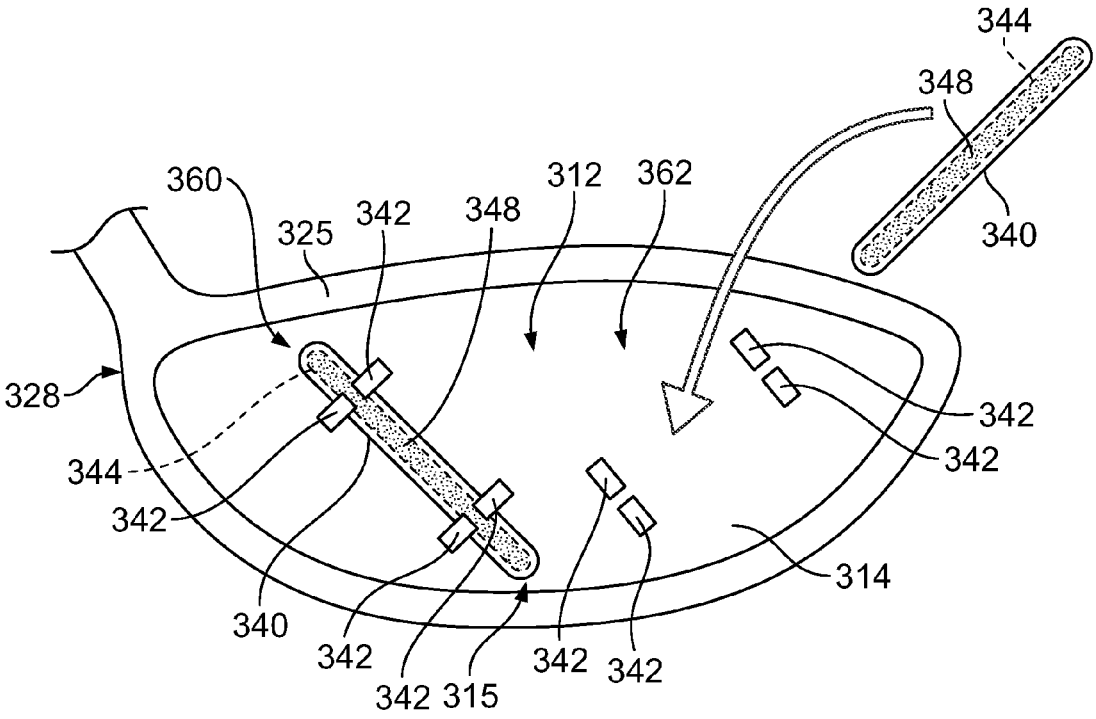
FIG. 10 is a plan view of a second illustrative embodiment of a face frame member for a head of a ball striking device according to the present invention, showing one stiffening element connected to the face frame member and a second stiffening element being connected to the face frame member.

In another embodiment, a ball striking head has one or more retainers on an inner surface of the face, which are adapted to hold one or more stiffening elements in contact with the inner face surface. FIGS. 9 and 10 illustrate embodiments of a face frame member 228, 328 for a ball striking head, where the inner surface 214, 314 of the face 212, 312 has one or more retainers 242, 342 adapted for holding stiffening elements 240, 340. Each stiffening element 240, 340 includes a chamber 244, 344 adapted to contain a viscous substance 248, 348 therein. The chambers 244, 344 are indicated by broken lines in FIGS. 9 and 10. The retainers 242, 342 are adapted to allow the stiffening elements 240, 340 to be connected, removed, and interchanged, as shown in FIGS. 9 and 10. The stiffening elements 240, 340 shown in FIGS. 9 and 10 are not configured to be emptied or refilled, but are configured to be interchanged with other stiffening elements containing different viscous substances in order to change the stiffening effect on the face 212, 312. In the embodiments illustrated, the retainers 242, 342 are resilient and flexible, allowing the stiffening elements 240, 340 to be snapped into the retainers 242, 342. However, it is understood that the retainers 242, 342 can be used to attach stiffening elements that have ports for emptying and refilling, as described above. In another embodiment, the retainers 242, 342 may be configured to removably connect to the stiffening elements 240, 340 in a different manner, such as a sliding connection, a threaded connection, an interference fit connection, an adhesive connection, a different type of snap fit connection, etc. As similarly described above, the stiffening elements 240, 340 may include cooperative structure to combine with the structure of the retainers 242, 342 to retain the stiffening elements 240, 340 in position, such as interlocking structures, threaded connections, etc.

In the embodiment shown in FIG. 9, the retainers 242 are positioned in the high-heel 260, high-toe 262, low-heel 264, and low-toe 266 regions of the face 112, and are oriented to allow the stiffening elements 240 to be placed in an X-shaped configuration. In the embodiment shown in FIG. 10, the retainers 342 are positioned to allow the stiffening elements 340 to be placed in a V-shaped configuration, extending from the high-heel region 360 and high-toe region 362 to the lower edge 315 of the face 312 proximate the center of the face 312. It is understood that in the embodiments of FIGS. 9 and 10, different types and configurations of stiffening elements may be connected to the retainers 242, 342, such as stiffening elements having different sizes and shapes than the stiffening elements 240, 340 illustrated. In additional embodiments, the retainers and associated stiffening elements may have other configuration and/or positioning.

Figure 11:
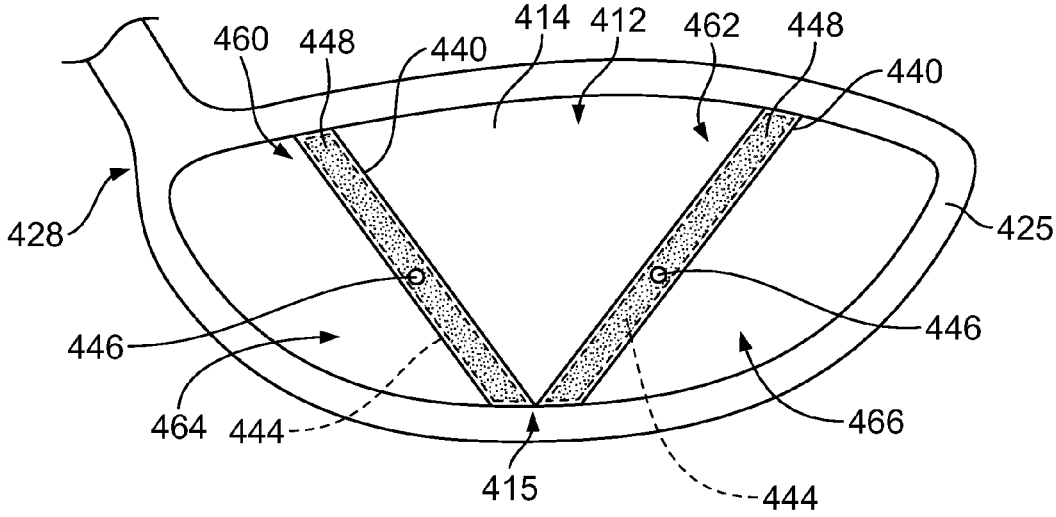
FIG. 11 is a plan view of one illustrative embodiment of a face frame member for a head of a ball striking device according to the present invention, having two stiffening elements integrally connected thereto.
Figure 12:
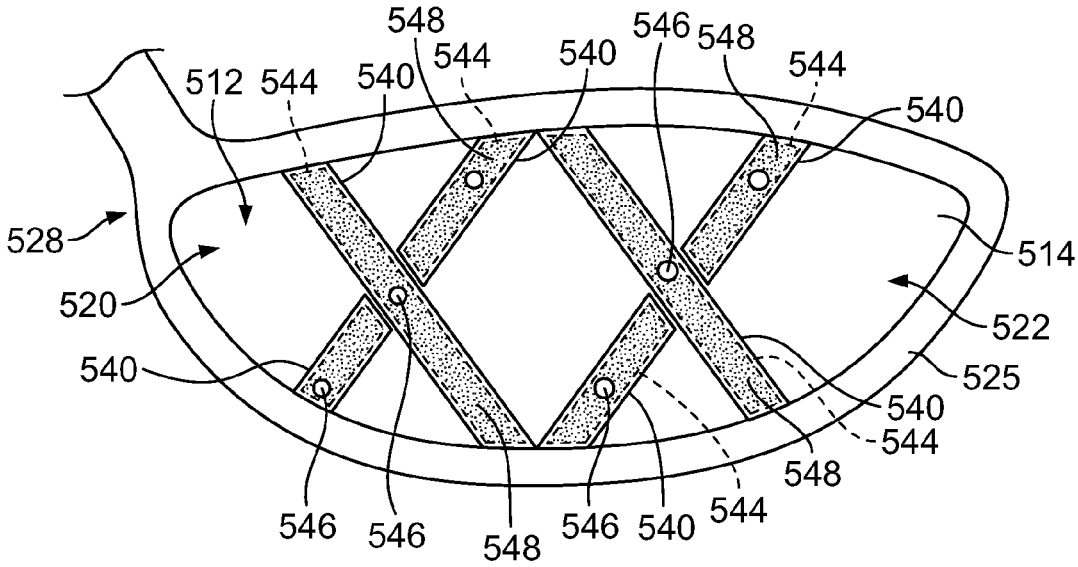
FIG. 12 is a plan view of a second illustrative embodiment of a face frame member for a head of a ball striking device according to the present invention, having a plurality of stiffening elements integrally connected thereto.
Figure 13:
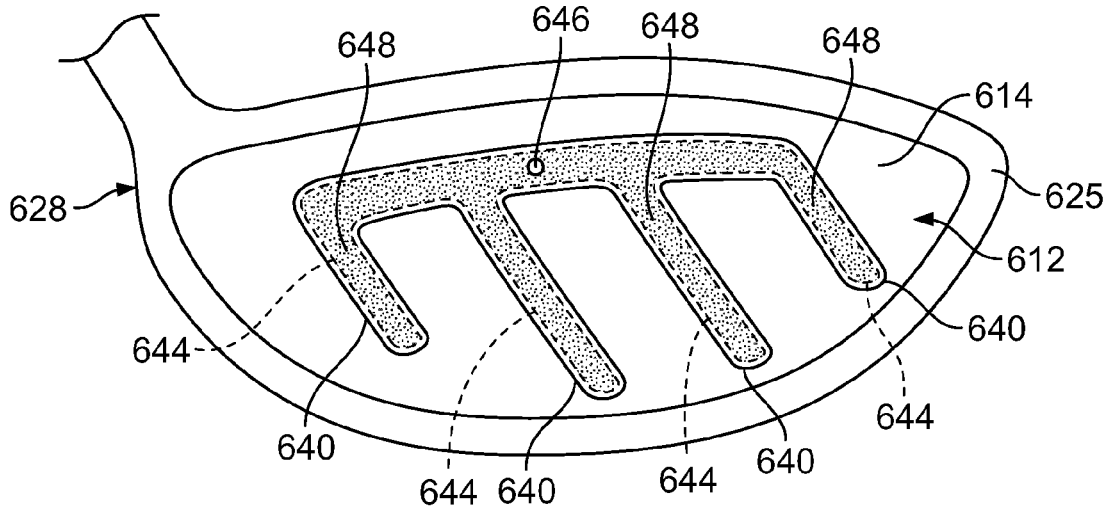
FIG. 13 is a plan view of a third illustrative embodiment of a face frame member for a head of a ball striking device according to the present invention, having a plurality of interconnected stiffening elements integrally connected thereto.

In another embodiment, the ball striking head has one or more stiffening elements permanently connected to the inner surface of the face. FIGS. 11-13 illustrate embodiments of a face frame member 428, 528, 628 for a ball striking head, where the face 412, 512, 612 has stiffening elements 440, 540, 640 permanently connected to the inner surface 414, 514, 614. In the embodiments shown, the stiffening elements 440, 540, 640 are integrally formed as part of the inner surface 414, 514, 614 of the face 412, 512, 612. In other embodiments, the stiffening elements 440, 540, 640 may be permanently connected to the face 412, 512, 612 in another manner, such as by an integral joining technique. Each stiffening element 440, 540, 640 includes a chamber 444, 544, 644 adapted to contain a viscous substance 448, 548, 648 therein. The chambers 444, 544, 644 are indicated by broken lines in FIGS. 11-13. The stiffening elements 440, 540 of the face frame members 428, 528 shown in FIGS. 11 and 12 also contain ports 446, 546 for filling, emptying, and refilling the viscous substance 448, 548 in each stiffening element 440, 540. The stiffening elements 640 of the face frame member 628 shown in FIG. 13 are interconnected, and can be filled, emptied, and refilled through a single port 646. As described above, this feature permits the stiffening effects of the stiffening elements 440, 540, 640 to be changed, by changing the substance contained in the stiffening elements 440, 540, 640.

In the embodiment shown in FIG. 11, stiffening elements 440 are positioned in a V-shaped configuration, extending from the high-heel region 460 and high-toe region 462 to the lower edge 415 of the face 412 proximate the center of the face 412. In the embodiment shown in FIG. 12, the stiffening elements 540 are positioned in two X-shaped formations, one proximate the heel 520 of the face 512 and one proximate the toe 522 of the face 512. In the embodiment shown in FIG. 13, the stiffening elements 640 are formed as a plurality of interconnected veins on the inner surface 614 of the face 612. It is understood that in the embodiments of FIGS. 11 and 12, the stiffening elements 440, 540 may also be interconnected, so that two or more of the stiffening elements 440, 540 can be filled, emptied, and refilled through the same port. Similarly, the stiffening elements 640 shown in FIG. 13 can be designed to be separate, with each fillable through separate ports. In additional embodiments, the stiffening elements may have other configuration and/or positioning.

Figure 14A:
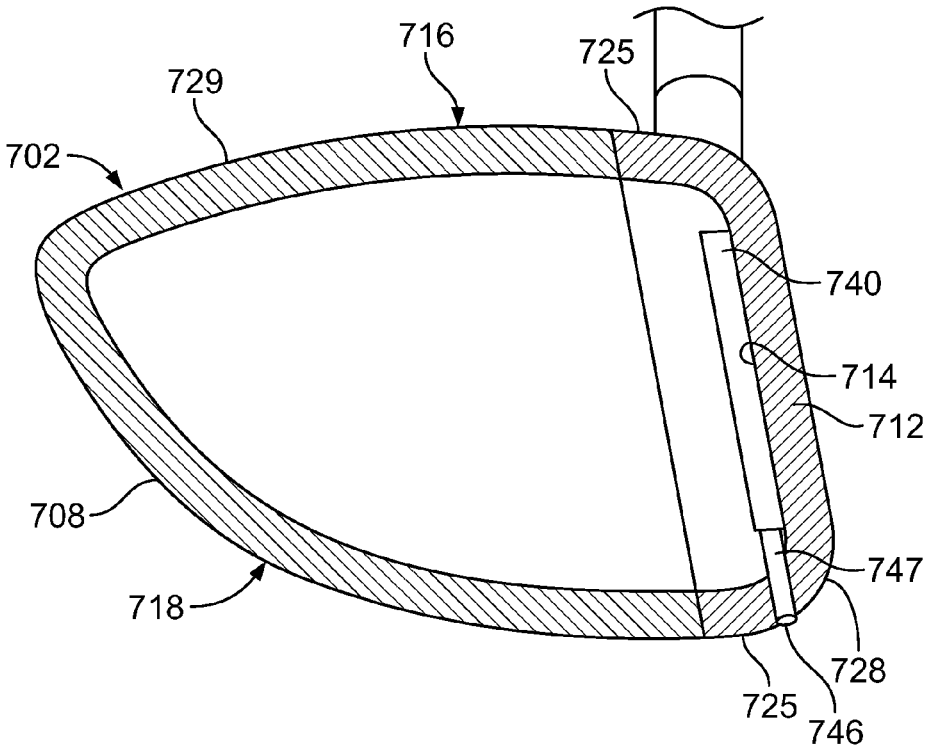
FIG. 14A is a cross-section view of one illustrative embodiment of a head of a ball striking device according to the present invention, having a stiffening element with a port accessible from the exterior of the head.
Figure 14B:
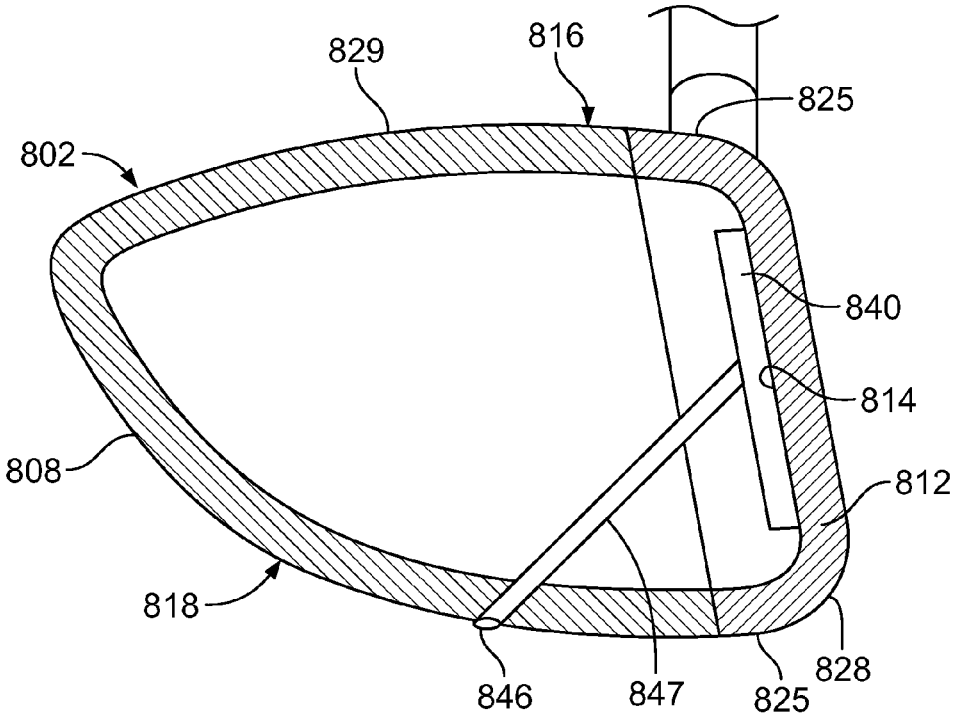
FIG. 14B is a cross-section view of a second illustrative embodiment of a head of a ball striking device according to the present invention, having a stiffening element with a port accessible from the exterior of the head.

In the embodiments shown in FIGS. 11-13, the stiffening elements 440, 540, 640 have ports 446, 546, 646 that can be accessed from behind the inner surface 414, 514, 614 of the face 412, 512, 614 such as by removing a body member (not shown) attached to the respective face frame member 428, 528, 628. In other embodiments, a ball striking head may be configured with one or more stiffening elements that have ports accessible from outside the head, such as through an exterior of the body. FIGS. 14A and 14B depict illustrative embodiments of ball striking heads 702, 802 having stiffening elements 740, 840 that are accessible through the body 708, 808. It is understood that the features of FIGS. 14A-B can be used with any of the stiffening elements described herein, including stiffening elements 440, 540, 640 shown in FIGS. 11-13.

In the embodiment shown in FIG. 14A, the head 702 is formed of a face frame member 728, which includes the face 712 and walls 725 extending rearward from the face 712, and a backbody member 729 connected to the face member 728. Additionally, the head 702 has a stiffening element 740 connected to the inner surface 714 of the face 712, and a port 746 for filling, emptying, and refilling the stiffening element 740. The port 746 is accessible through one of the walls 725 of the face frame member 728, via a passage 747 extending from the wall 725 to the stiffening element 740. In the embodiment shown in FIG. 14B, the head 802 is formed of a face frame member 828, which includes the face 812 and walls 825 extending rearward from the face 812, and a backbody member 829 connected to the face member 828. Additionally, the head 802 has a stiffening element 840 connected to the inner surface 814 of the face 812, and a port 846 for filling, emptying, and refilling the stiffening element 840. The port 846 is accessible through the outer surface of the backbody member 829, via a passage 847 extending from the backbody member 829 to the stiffening element 840. The passages 747, 847 and ports 746, 846 in FIGS. 14A-B are configured for insertion of a needle (such as a hypodermic needle) to inject a viscous substance into the stiffening element 740, 840. Alternately, the passages 747, 847 may be another type of pipe, tube, conduit, or any other such structure configured for filling in another manner. In the embodiments shown in FIGS. 14A-B, the ports 746, 846 are located on the bottom side 718, 818 of the head 702, 802, which can improve the aesthetics of the head 702, 802, as well as lowering the center of gravity of the head 702, 802. In other embodiments, the head may include a port configured for accessing the stiffening element from the exterior of the head in a different manner, such as through the top side of the head, or through the face.

Figure 15C:
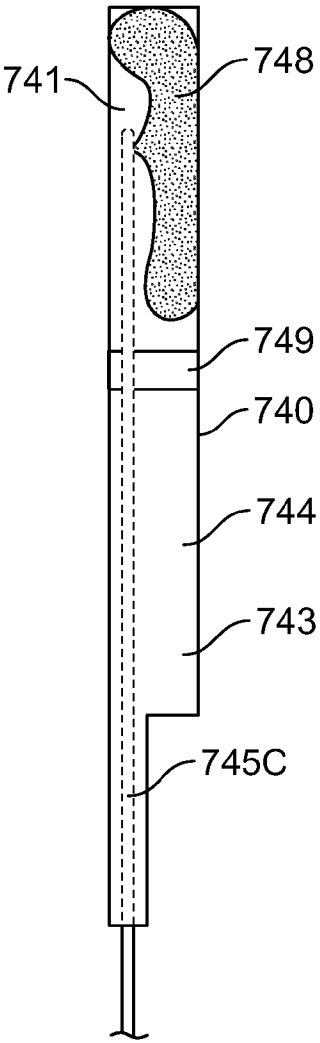
FIG. 15C is a cross-section view of the stiffening element of FIG. 14A, having a penetrable barrier, with a deep-insertion needle injecting a viscous substance into the chamber of the stiffening element.
Figure 15B:
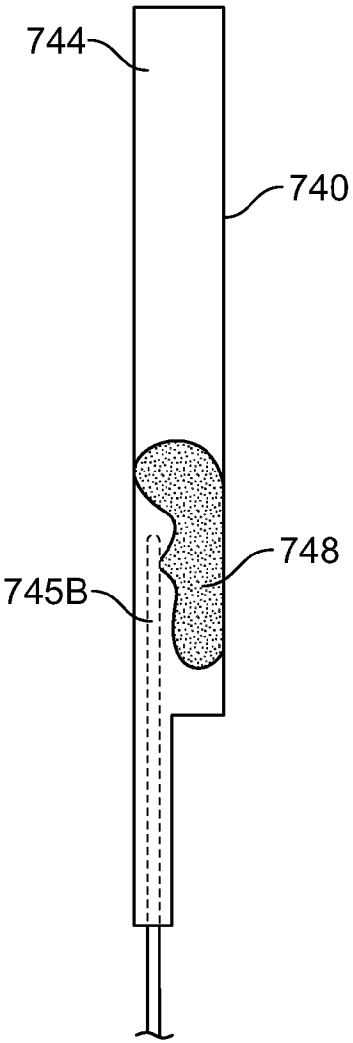
FIG. 15B is a cross-section view of the stiffening element of FIG. 14A, with a shallow-insertion needle injecting a viscous substance into the chamber of the stiffening element.
Figure 15A:
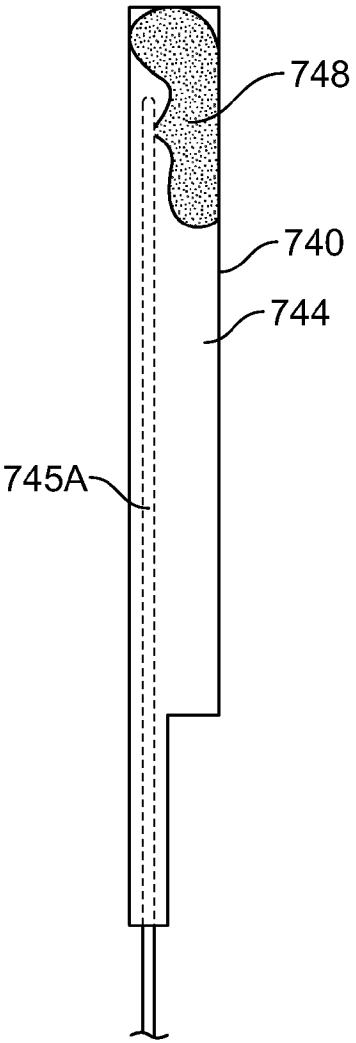
FIG. 15A is a cross-section view of the stiffening element of FIG. 14A, with a deep-insertion needle injecting a viscous substance into the chamber of the stiffening element.

FIGS. 15A-C illustrate the stiffening member 740 of FIG. 14A being filled with a viscous substance 748 through the port 746 by a needle 745A-C. As shown in FIGS. 15A-B, needles 745A-B of varying insertion lengths can be used to fill specific areas of the chamber 744 of the stiffening member 740 with the viscous substance. For example, in FIG. 15A, a deep-inserted needle 745A is used to inject the viscous substance 748 at the top end of the chamber 744, distal from the port 746. The needle 745A can be backed up to gradually fill the chamber 744 toward the port 746, as the material will often tend to "puddle" around the injection point. As another example, in FIG. 15B, a shallow-inserted needle 745B is used to inject the viscous substance 748 at the bottom end of the chamber 744, near the port 746. The deep-inserted needle 745A and the shallow-inserted needle 745B may be different needles having different lengths, or may be the same needle inserted at different depths. It is understood that other needles with different insertion depths can be used to fill other areas of the chamber 744. Accordingly, the chamber 744 may not be completely filled with the viscous substance, and in some embodiments, if desired, a user is able to selectively fill only a specific portion of the chamber 744. Additionally, the stiffening element 740 may include one or more penetrable barriers dividing the chamber 744 into two or more separate chamber sections. Such a penetrable barrier may take the form of a membrane, a plug, a stopper, or other similar structure. The stiffening element 740 in FIG. 15C includes a penetrable barrier 749 that divides the chamber 744 into two separate chamber sections 741, 743. As also shown in FIG. 15C, a deep-inserted needle 745C can be used to penetrate the barrier 749 and inject the viscous substance 748 into the distal chamber section 741. The barrier 749 is capable of retaining the viscous substance 748 in the distal chamber section 741 and prevent leakage into the proximal chamber section 743. For example, the barrier 749 may be made from a resilient material, such as rubber or a similar material, that will expand to close the hole made by the needle 745C after removal of the needle. In a further embodiment, the chamber 744 may contain a porous material, such as a foam, netting, etc., that may assist in holding the viscous substance in place in the chamber 744.

Some embodiments of the stiffening elements described herein are generally accessible for filling, emptying, and refilling the chamber with viscous substances. As described above, the stiffening element may be accessible from the exterior of the assembled ball striking head, such as the embodiments shown in FIGS. 14A-B and 15A-C. In another embodiment, a portion of the body 108 of the head 102 can be removed in order to provide access to a stiffening element that is contained inside the head 102. As used herein, removal of any portion of the body 108 includes non-total or non-permanent removal. For example, opening a swinging or sliding door formed in the body 108 to provide access to the stiffening element constitutes removal of that portion, even though the portion is not completely removed. As another example, removal of a piece that can be reconnected later also constitutes removal.

In the embodiment shown in FIGS. 3 and 4, the backbody member 129 is removable in order to provide access to the stiffening element 140. Once the stiffening element 140 has been filled, emptied, and/or refilled, the backbody member 129 can be reattached. Additionally, a plurality of different backbody members can be provided, all of which can be attached to the face frame member 128 in place of the backbody member 129 illustrated in FIGS. 3 and 4. The ability to interchange backbody members 129 permits greater control over various features and properties of the club head, including weighting, weight distribution, aerodynamics, and others. It is contemplated that a kit or system can be provided that contains a face frame member 128 and a plurality of different backbody members 129 and/or gaskets (not shown) that are interchangeable. The kit may also include one or more stiffening elements 140, as described above. For example, the kit may include one or more stiffening elements 140 permanently attached to the face 112, and may additionally or alternately contain one or more stiffening elements 140 that are connectable to the face 112. Such stiffening elements 140 contained in the kit may also be interchangeable with one another, such as the interchangeable cartridges 140A-D described above with respect to FIGS. 5-8.

Several different configurations for removable and/or interchangeable backbody members are shown and described in U.S. patent application Ser. No. 12/192,402, filed Aug. 15, 2008, which is incorporated by reference herein and made part hereof. For example, FIGS. 16-23 illustrate various embodiments of golf club heads 902, 1002, 1102, 1202, each containing a face frame member with a cup face structure and a removable backbody member.

Figure 16:
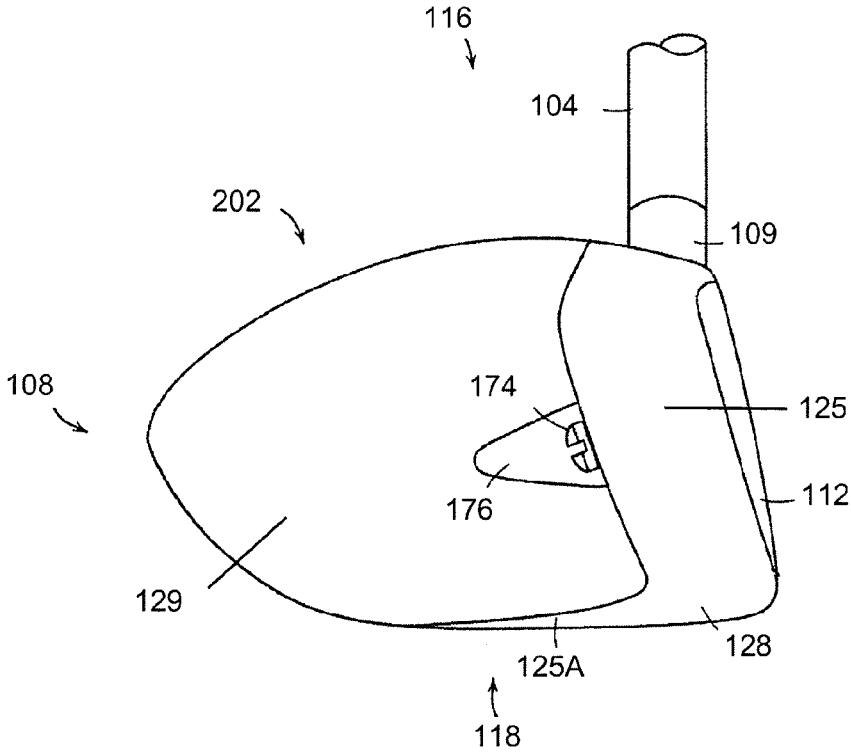
FIG. 16 is a side view of a second illustrative embodiment of a head of a ball striking device according to the present invention.
Figure 17:
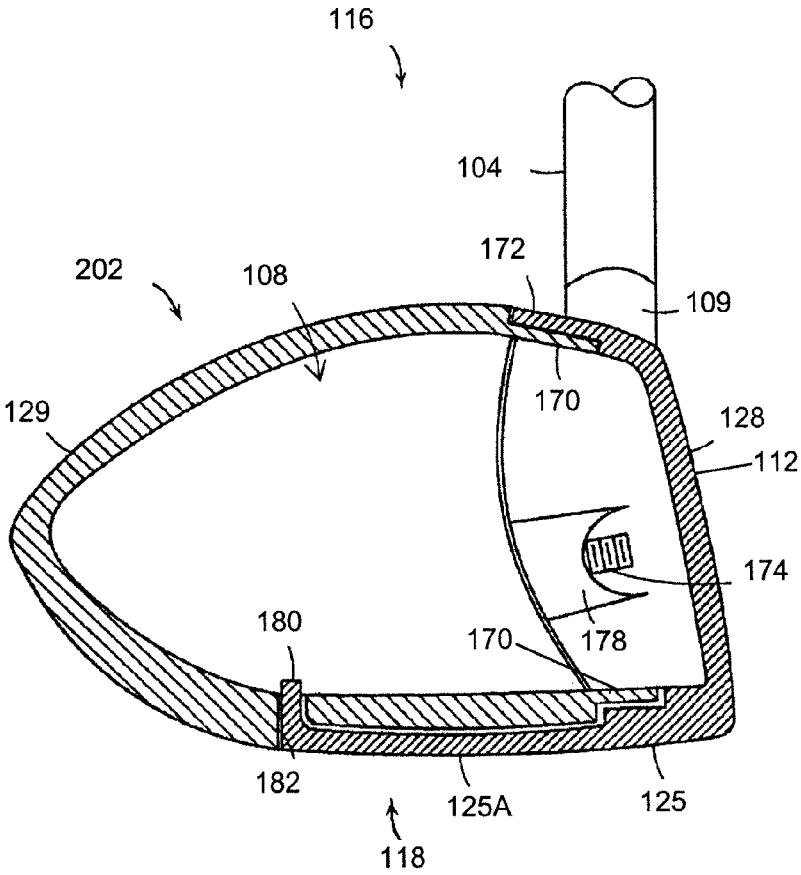
FIG. 17 is a cross-section view of the head of FIG. 16.

FIGS. 16-17 illustrate one such illustrative embodiment of a head 902, which contains many basic features similar to the head 102 described above. The head 902 is formed of a face frame member 128 with a cup face structure, having the face 112 and a wall or walls 125 extending rearward from the face 112, and a backbody member 129 connected to the face frame member 128. The walls 125 include an extended sole portion 125A on the sole 118 of the head 202.

The sole portion 125A projects from a lower edge of the face 112, thereby extending toward the rear portion 120 of the head 902. The sole portion 125A may extend all the way to the rear edge of the head 202. In one embodiment, the sole portion 125A extends more than halfway across the front-to-rear length of the head 202.

The backbody member 129 is removably attached to the face frame member 128. In one aspect and as embodied in FIGS. 10-11, the backbody member 129 is formed as a hollow body. As best shown in FIG. 11, the backbody member 129 includes an internal concavity at least partially enclosed by the walls thereof. The backbody member 129 further includes an opening that faces the face frame member 128. In the illustrated embodiment, the backbody member 129 includes a perimeter flange 170 for complementary insertion into a perimeter flange 172 on the wall(s) 125 of the face frame member 128. When the backbody member 129 is attached to the face frame member 128, a closed or substantially closed internal cavity is formed within the head 902. It is understood that the perimeter flange 170 of the backbody member 129 may overlay the perimeter member 172 of the face frame member 128. Optionally, if desired a gasket or other such material may be provided at the joint between the backbody member 129 and the face frame member 128 (e.g., fully or partially around the perimeter of the joint) to dampen noise or vibration, reduce rattling, provide sealing, etc.

In the illustrative embodiment of FIGS. 16-17, the backbody member 129 is removably and replaceably coupled to the face frame member 128 by threaded fasteners 174. In the embodiment shown in FIGS. 16-17, one threaded fastener 174 is located on the toe side 122 of the head 902 and the other threaded fastener 174 is located on the heel side 120. Each of these threaded fasteners has a longitudinal axis that is oriented approximately perpendicular to the plane of the face 112. The backbody member 129 includes countersunk portions 176 to allow for insertion and removal of the threaded fasteners 174 at the proper angle. As best shown in FIG. 11, in this particular embodiment, for each fastener, the face frame member 128 includes a boss 178 attached to or formed at an inner side wall. The end of the threaded portion of fastener 174 extends into and/or through the boss 178.

As described above, the face frame member 128 of the embodiment of FIGS. 16-17 includes the sole portion 125A. An elastically-deformable element couples the backbody member 129 to the sole portion 125A in this example structure. Specifically, the rearward-most end of the sole portion 125A includes a tab 180. The tab 180 is designed to slide into a slot 182 defined in the backbody member 129, thereby coupling the sole portion 125A to the bottom of the backbody member 129. The tab 180 is elastically deformable, thereby facilitating the insertion of the tab 180 into the complementary slot 182, and further providing a biasing of the backbody member 129 relative to the face frame member 128. Biasing may be used to remove unwanted play between the two detachably attached members. A person of ordinary skill in the art will appreciate that other fastening mechanisms may be used to detachably attach the sole portion 125A to the backbody member 129, given the benefit of this disclosure.

In an alternate embodiment (not shown), the sole portion 125A may include a through-hole at its rearward-most end, so that the sole portion 125A may be fastened to the backbody member 129 with a threaded fastener (e.g., threaded into a boss or an attached nut member included with the body member structure).

Figure 18:
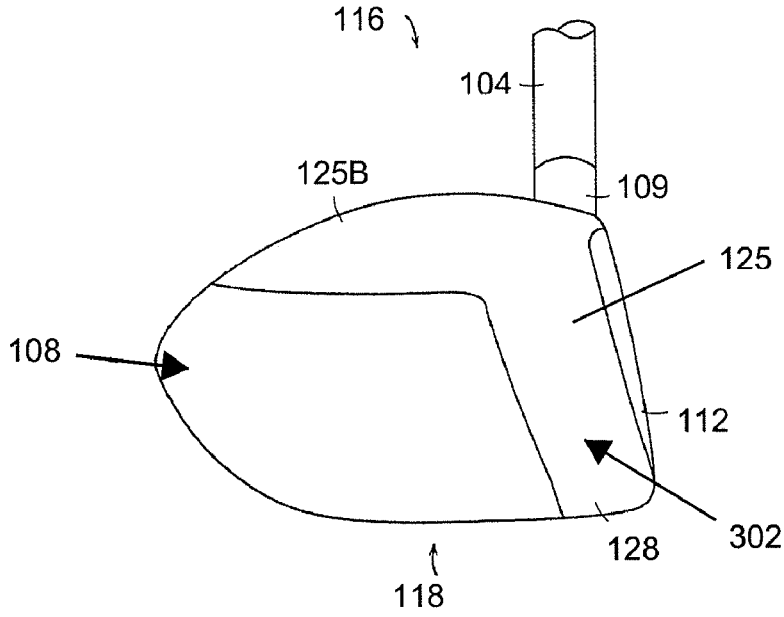
FIG. 18 is a side view of a third illustrative embodiment of a head of a ball striking device according to the present invention.
Figure 19:
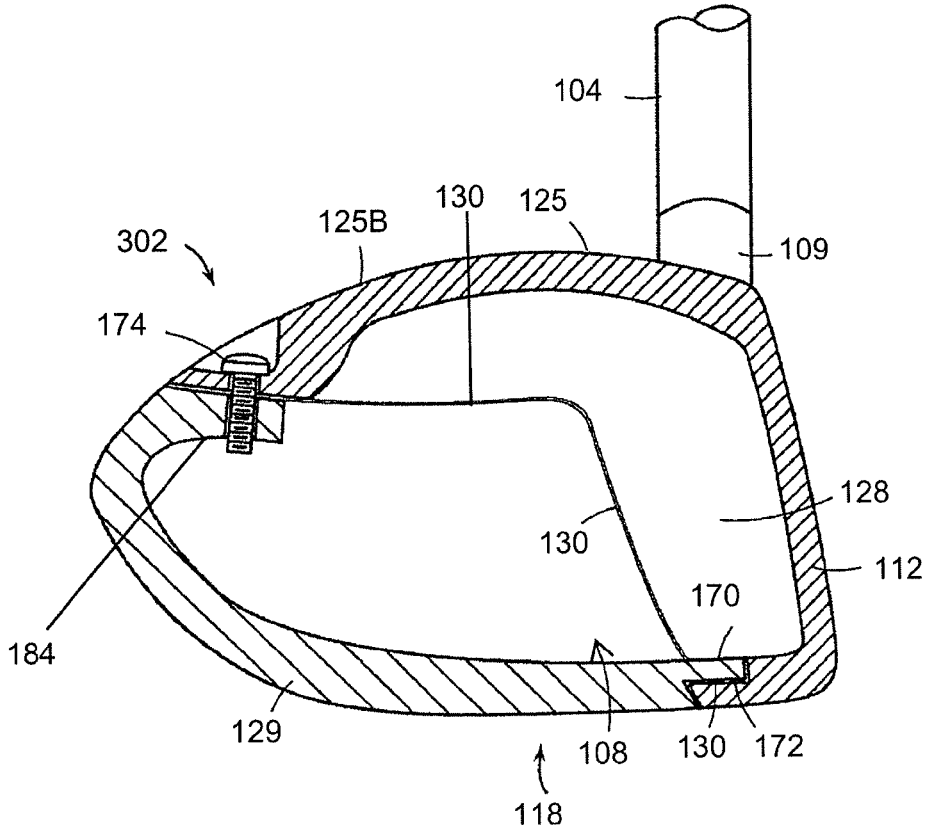
FIG. 19 is a cross-section view of the head of FIG. 18.

In the embodiment of the head 1002 shown in FIGS. 18-19, the walls 125 of the face frame member 128 include a crown portion 125B adapted for connection to the backbody member 129. The crown portion 125B projects rearwardly from a top portion of the face 112. In this particular embodiment, the crown portion 125B is integrally formed with the face frame member 128. At the rearward-most end of the crown portion 125B, a threaded fastener 174 is provided to detachably attach the backbody member 129 to the face frame member 128. Additional fasteners may be provided at other locations, if desired.

The backbody member 129 may include an inner cavity partially enclosed by the walls thereof. The upper portion of a rear wall of the backbody member 129 extends inward and provides a platform 184 for receiving the threaded portion of fastener 174. At the bottom portion of the backbody member 129, a flange 170 overlaps a complementary flange 172 formed in the wall 125 of the face frame member 128. In this embodiment, a layer of removable, liquefiable adhesive 130 is located between the two flanges 170, 172, to function as a gasket. Further, the layer of removable, liquefiable adhesive 130 extends up and around the side walls and crown portion of the face frame member 128 where it interfaces with the backbody member 129. To detach the backbody member 129 from the face frame member 128, the fastener 174 is removed and then the removable adhesive is heated until it melts. Upon liquefaction of the adhesive, the backbody member 129 is debonded from the face frame member 128 such that the backbody member 129 easily slides apart from the face frame member 128. It is understood that the members 128, 129 can be connected without the adhesive, or with a different type of gasket in place of the adhesive.

Figure 20:
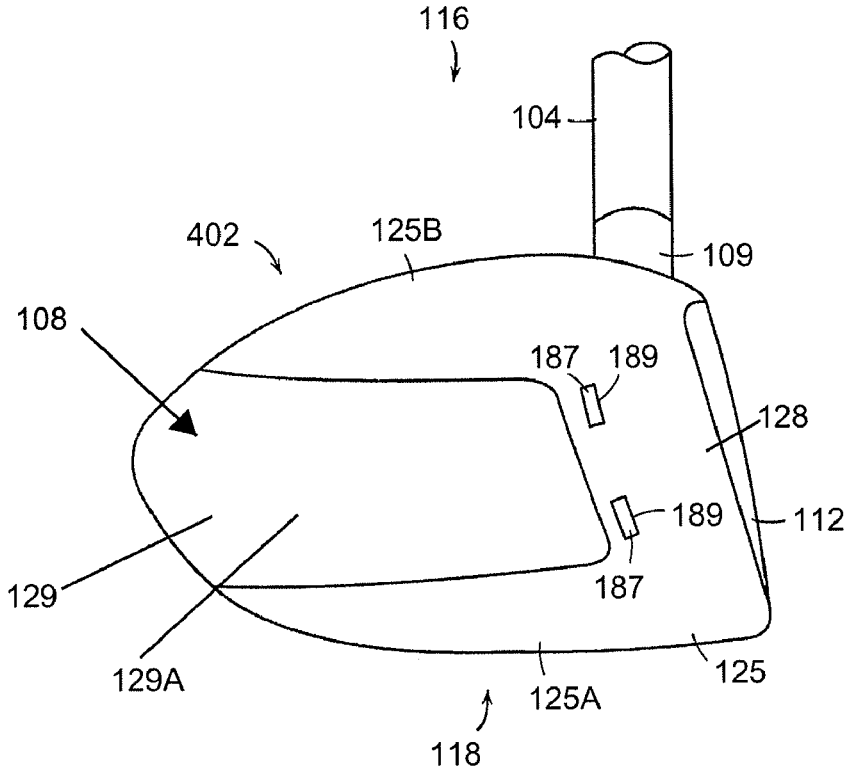
FIG. 20 is a side view of a fourth illustrative embodiment of a head of a ball striking device according to the present invention.
Figure 21:
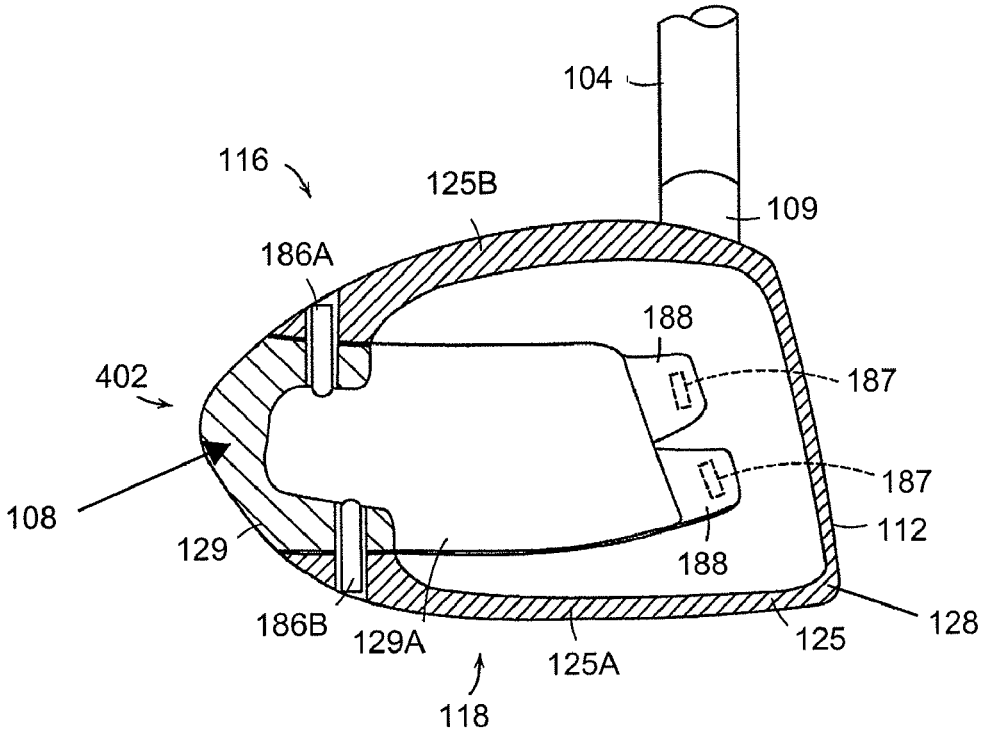
FIG. 21 is a cross-section view of the head of FIG. 20.

In the embodiment of the head 1102 shown in FIGS. 20-21, the face frame member 128 has a cup face structure including the face 112 and walls 125 extending rearward from the face 112. The walls 125 include a crown portion 125B and a sole portion 125A. The backbody member 129 includes a concavity partially enclosed by the walls thereof. In this embodiment, the walls form a roughly U-shaped enclosure of the concavity, with two side walls 129A extending forwardly from a rear wall portion. The crown portion 125B projects rearwardly from a top portion of the face 112. The sole portion 125A projects rearwardly from a bottom portion of the face 112. In this particular embodiment, both the crown portion 125B and the sole portion 125A are integrally formed with the face frame member 128.

As best shown in FIG. 21, at the rearward-most end of the crown portion 125B, a through-hole is provided to accept a portion of a first pin 186*a*. A corresponding through-hole for accepting a different portion of the first pin 186*a* is provided in a top, rear portion of the backbody member 129. At the rearward-most end of the sole portion 125A, a through-hole is provided to accept a portion of a second pin 186*b*. A corresponding through hole for accepting a different portion of the second pin 186*b* is provided in a bottom, rear portion of the backbody member 129. The pins 186*a*, 186*b* removably attach the rear portion of the backbody member 129 to the rear portions of the face frame member 128 (i.e., the rear portion of the crown portion 125B and the rear portion of the sole portion 125A). In this particular embodiment, the pins 186*a*, 186*b* are elastically-deformable roll or spring pins. Optionally, in another embodiment, the pins 186*a*, 186*b* may include a plastically-deformable sleeve and a central (essentially) non-deformable pin.

At the forward-most ends of the side walls 129A of the backbody member 129, a pair of tabs 188 is provided in this particular embodiment. The tabs 188 may be formed of the same material as the rest of the backbody member 129, and further, may be formed integrally with the backbody member 129. In the attached configuration, the tabs 188 lie alongside the inner surface of a side wall of the face frame member 128. Each tab 188 includes a projection 187 that extends outwardly toward the side wall of the face frame member 128 and engages an aperture 189 of the face frame member 128. FIG. 21 shows a dashed outline of the projections 187, as they are located on the opposite side of the tabs 188 in this view.

To detach the backbody member 129 from the face frame member 128, the pins 186*a*, 186*b* are driven into the cavity, such as with a pin driver. Then, the projections 187 are disengaged from the apertures 189 by either using a tool to push the projections 187 inward or by squeezing the side walls 129A of the backbody member 129 toward one another. Of course, if desired, the various club head components illustrated in FIGS. 20-21 may be connected using other types of connectors, such as the threaded mechanical connectors described above.

It is to be appreciated that any number of fastening elements can be provided on the golf club head and that the location and orientation of the fastening elements described herein are merely illustrative. Other suitable methods for detachably attaching the backbody member 129 to the face frame member 128 will be apparent to persons of ordinary skill in the art, given the benefit of this disclosure.

Figure 22:
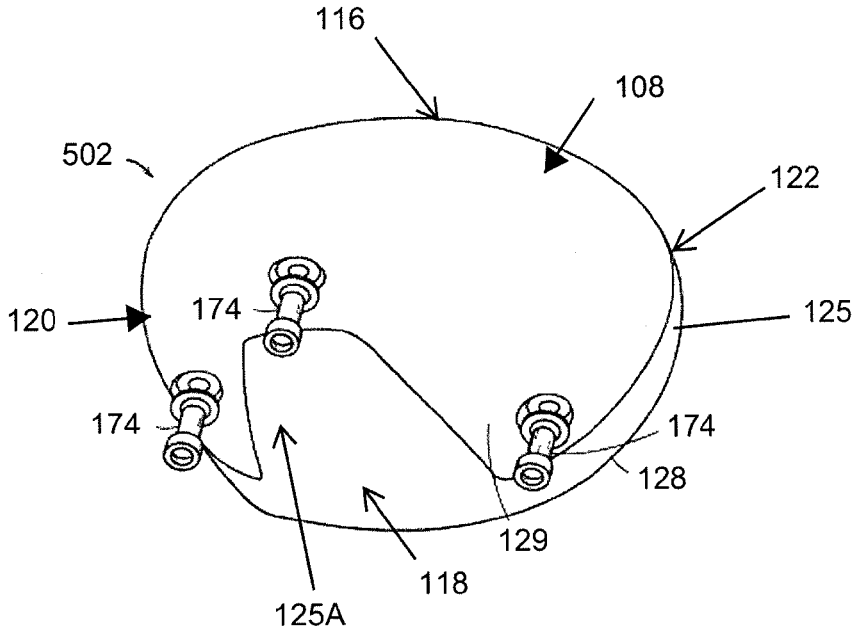
FIG. 22 is a side view of a fifth illustrative embodiment of a head of a ball striking device according to the present invention.
Figure 23:
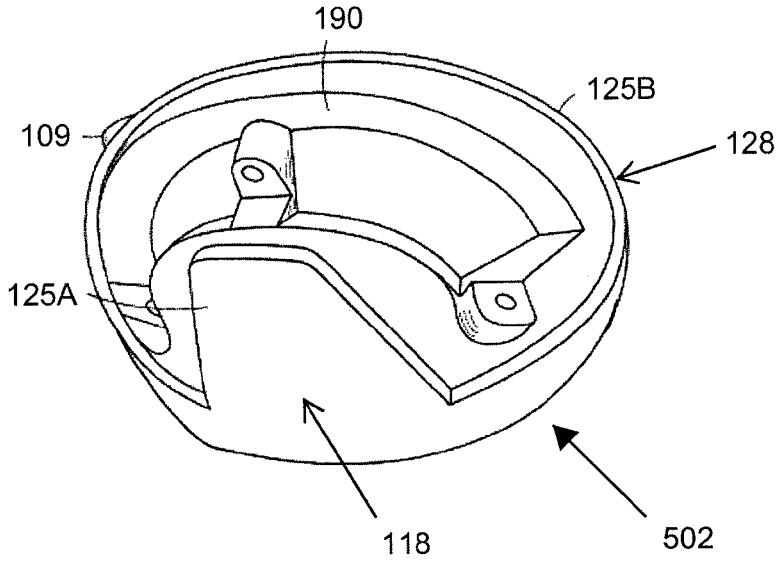
FIG. 23 is a cross-section view of the head of FIG. 22.

In an embodiment of the head 1202 shown in FIGS. 22-23, the face frame member 128 has a cup face structure including the face 112 and walls 125 extending rearward from the face 112. The walls 125 include a sole portion 125A and a crown portion 125B, and terminate in a rear face 190 substantially opposed to the face 112. The backbody member 129 is detachably attached to the rear face 190 of the face frame member 128. In the embodiment shown in FIGS. 22-23, the backbody member 129 extends over the entire rear face 190 of the face frame member 128 and over a portion of the sole 118 of the head 1202. As best shown in FIG. 22, portions of the exterior sole portion 125A of the backbody member 129 extend on either side of the sole portion 125A of the face frame member 128.

Three fasteners 174 mechanically fasten the backbody member 129 to the face frame member 128. The fasteners 174 generally extend perpendicular to the sole portion 125A, i.e., vertically when the head 1202 is in the striking position. Although three fasteners are shown, fewer or more fasteners may be used to attach the backbody member 129 to the face frame member 128.

As shown in FIG. 23, the rear face 190 may be shaped or contoured to accommodate the attachment of the backbody member 129, for example, the rear face 190 may include bosses for accommodating the fasteners 174. In this embodiment, the backbody member 129 is shaped as a substantially shell-like structure such that an internal concavity is defined therein. Thus, when the backbody member 129 is attached to the face frame member 128, an enclosed or a substantially enclosed secondary body cavity is formed therebetween.

As described above with respect to the head 102 shown in FIGS. 3-4, the backbody members 129 of the heads 902, 1002, 1102, 1202 described above can be removed and reconnected, which can not only allow for access to the stiffening element, but also for interchanging of the head 102 with one of a plurality of different heads 902, 1002, 1102, 1202. As also described above, the heads 902, 1002, 1102, 1202 may include a gasket between the face frame member 128 and the backbody member 129, which can be removable and interchangeable as well. Still other embodiments of ball striking heads may have portions of the head that are removable by other mechanisms and using other structural configurations, and it is understood that such embodiments are included within the scope of the invention.

It is understood that the ball striking heads 102, et seq. described herein may have additional features affecting the flexibility of the face or areas thereof. For example, the heads 102, et seq. may have areas of relatively increased or decreased face thickness. Additionally, the heads 102, et seq. described herein may contain a greater or smaller number of stiffening elements, creating additional areas of relative stiffness and flexibility. It is contemplated that in embodiments with multiple stiffening elements, various ones of the stiffening elements may be formed of different materials or may be strengthened or otherwise designed with specific properties through processing techniques.

Heads 102, et seq. incorporating the stiffening elements 140, et seq. disclosed herein may be used as a ball striking device or a part thereof. For example, a golf club 100 as shown in FIG. 1 may be manufactured by attaching a shaft or handle 104 to a head that is provided, such as the head 102 as described above. "Providing" the head, as used herein, refers broadly to making an article available or accessible for future actions to be performed on the article, and does not connote that the party providing the article has manufactured, produced, or supplied the article or that the party providing the article has ownership or control of the article. In other embodiments, different types of ball striking devices can be manufactured according to the principles described herein. Manufacturing the head 102 may include attachment of a backbody member 129 to a face frame member 128, as described above.

Additionally, the head 102, et seq., golf club 100, or other ball striking device may be fitted or customized for a person by adjusting the stiffening element 140, et seq. Such customization may include selecting one or more viscous substances to insert into one or more stiffening elements 140, et seq., along with filling or emptying and refilling the stiffening element(s) 140, et seq., in order to achieve a desired stiffening effect and/or a desired stiffness profile across the face 112, et seq. In some embodiments, as described above, filling, emptying, and/or refilling the stiffening element may include removal of a portion of the head, such as removal of the backbody member 129. Also, in some embodiments, customization of the head 102, et seq., golf club 100 or other ball striking device may include removing the cartridge housing the stiffening element 140 et seq. and replacement with one of a plurality of other stiffening elements. Further, in some embodiments, customization of the head 102, et seq., golf club 100, or other ball striking device may include removing the backbody member 129 and replacement with one of a plurality of other different backbody members.

In one example, a club head 102 et seq. may be fitted for a golfer based on the golfer's hitting tendencies, such as if the golfer has a consistent location of contact in a particular area of the face 112 et seq. Once a consistent location of contact is identified, other areas of the face can be stiffened using the techniques described herein, such as by connecting stiffening elements 140 et seq. to the face 112 et seq. in those particular areas, or by selectively injecting viscous substances into one or more stiffening elements 140 et seq. in those particular areas. The area around the consistent location of contact is not stiffened, and as a result, the contact area has increased COR response, while the overall face conforms to USGA rules for COR response. As one example, with reference to the configuration shown in FIG. 11, a golfer may tend to hit the ball on the high heel area 460 of the face 412. In this embodiment, the stiffening element 440 on the left in FIG. 11 may be partially filled in the bottom section, and the stiffening element 440 on the right in FIG. 11 may be completely filled. This leaves the high toe area 462, the low heel area 464, and the low toe area 466 with locally increased face stiffness, and the high heel area 460 of the face 412 with locally increased COR response. Similar strategies can be used to provide other fitting arrangements with specific areas of locally increased COR response.

The ball striking devices and heads therefor as described herein provide many benefits and advantages over existing products. For example, the stiffening elements can be strategically located and filled with selected substances to provide local stiffness and flexibility in the face of the head so that certain areas of the face will have a COR that is higher than other areas, without exceeding COR limits set by regulatory authorities. The head can be configured and adjusted so that the areas of the face that most frequently impact the ball during play will have a higher COR. A ball impacting these specific locations on the face will have more energy and velocity transferred to it, thus resulting in longer hits. Additionally, the configuration of the stiffening element(s) and the resultant area(s) of local stiffness and flexibility can affect the direction, trajectory, and spin of an impacted ball. Thus, the head can be further configured and adjusted so that areas of the face that most frequently impact the ball during play will produce a straighter and truer ball flight.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A golf club head comprising:

a face having an outer surface configured for striking a ball;

a body connected to the face;

a stiffening element contacting an inner surface of the face, the stiffening element including a chamber containing a first viscous substance, wherein a viscosity of the first viscous substance influences a stiffening effect on an area of the face contacted by the stiffening element;

a retainer for holding the stiffening element, wherein the stiffening element is removable from the retainer and is further interchangeable with a second stiffening element including a chamber containing a second viscous substance having a different viscosity from the first viscous substance.

2. The golf club head of claim 1, wherein the stiffening element further comprises a port in communication with the chamber, the port configured for at least one of filling and emptying the first viscous substance.

3. The golf club head of claim 2, wherein the port is accessible through an outer surface of the body, for at least one of filling and emptying the first viscous substance.

4. The golf club head of claim 1, wherein the stiffening element further comprises a plurality of chambers, each chamber adapted to contain a viscous substance.

5. The golf club head of claim 4, wherein at least two of the chambers contain viscous substances having different viscosities from each other.

6. The golf club head of claim 4, wherein the stiffening element comprises a removable and interchangeable cartridge including the plurality of chambers.

7. The golf club head of claim 1, further comprising:

a plurality of stiffening elements contacting the inner surface of the face, each stiffening element including a chamber adapted to contain a viscous substance.

8. The golf club head of claim 7, wherein at least two of the stiffening elements contain viscous substances having different viscosities from each other.

9. The golf club head of claim 1, wherein the stiffening element further contains a gaseous substance, and the pressure of the gaseous substance further influences the stiffening effect.

10. The golf club head of claim 1, wherein at least a portion of the body is removable to provide access to the stiffening element.

11. The golf club head of claim 1, further comprising:

a face member comprising the face and a wall extending rearward from the face; and a backbody member connected to the wall of the face member, wherein the backbody member and at least a portion of the wall of the face member define the body, wherein the backbody member is removable to provide access to the stiffening element.

12. A golf club comprising the golf club head of claim 1 and a shaft connected to the golf club head.

13. A face member for use in a ball striking device, comprising:

a face having an outer surface configured for striking a ball and an inner surface located rearward and opposite of the outer surface;

a wall extending rearward from an outer periphery of the face;

a stiffening element contacting an inner surface of the face, the stiffening element including a chamber containing a first viscous substance, wherein a viscosity of the first viscous substance influences a stiffening effect on an area of the face contacted by the stiffening element; and a retainer for holding the stiffening element, wherein the stiffening element is removable from the retainer and is further interchangeable with a second stiffening element including a chamber containing a second viscous substance having a different viscosity from the first viscous substance.

14. The face member of claim 13, wherein the stiffening element further comprises a port in communication with the chamber, the port configured for filling and emptying the first viscous substance from the chamber.

15. The face member of claim 13, wherein the stiffening element further comprises a plurality of chambers, each chamber adapted to contain a viscous substance.

16. The face member of claim 13, further comprising:

a plurality of stiffening elements contacting the inner surface of the face, each stiffening element including a chamber adapted to contain a viscous substance.

* * * * *